United States Patent [19]

Forno et al.

[11] Patent Number: 4,569,285

[45] Date of Patent: Feb. 11, 1986

[54] DEVICE FOR SHIFTING A COMPENSATOR ROLLER IN A PRINTING PRESS

[75] Inventors: Mario Forno, Casale Monferrato; Gianfranco Gibellino, Trino Vercellese; Mario Saterini, Casale Monferrato, all of Italy

[73] Assignee: Officine Meccaniche Giovanni Cerutti S.p.A., Casale Monferrato, Italy

[21] Appl. No.: 603,686

[22] Filed: Apr. 25, 1984

[30] Foreign Application Priority Data

Apr. 29, 1983 [IT] Italy ..... 20856 A/83

[51] Int. Cl.[4] ..... B41F 13/26; B41F 13/38

[52] U.S. Cl. ..... 101/248; 101/178; 101/232; 226/11; 226/24; 226/42; 226/44; 226/119

[58] Field of Search ..... 101/178, 181, 224, 225, 101/227, 228, 232, D21; 226/11, 24, 40, 42, 44, 113, 118, 119

[56] References Cited

U.S. PATENT DOCUMENTS

| | | | |
|---|---|---|---|
| 2,658,432 | 11/1953 | Baumgartner | 226/119 |
| 4,215,609 | 8/1980 | Coburn | 83/499 |
| 4,360,137 | 11/1982 | Noe | 226/119 |
| 4,452,140 | 6/1984 | Isherwood | 101/248 |

*Primary Examiner*—Edgar S. Burr
*Assistant Examiner*—William L. Klima
*Attorney, Agent, or Firm*—Webb, Burden, Robinson & Webb

[57] ABSTRACT

A device for shifting a compensator roller in a printing press, comprising an actuator assembly which may be controlled for either high speed or low speed movement of the compensator roller.

3 Claims, 2 Drawing Figures

DEVICE FOR SHIFTING A COMPENSATOR ROLLER IN A PRINTING PRESS

BACKGROUND OF THE INVENTION

This invention relates to a device for shifting a compensator roller in a printing press.

It is a well known fact that printing presses, and rotary printing presses especially, comprise rollers for guiding a paper web through the machine, as well as to correct any out-of-register condition. At least one roller cooperates with each printing unit which functions as a compensator roller and is mounted, to that aim, for up-down movement, whereby it can assume either an uppermost position or lowermost position relative to the stationary structure of the rotary printing press. For controllably shifting this compensator roller between such extreme positions, a conventional gearing is provided which is driven by a controllable motor, such as a DC motor, via vertically extending parallel threaded shafts which are drivingly connected to end hubs on the horizontally positioned compensator roller, to thus enable the compensator roller to be accurately raised and lowered.

It is also known that when feeding a paper web into a rotary press during printing start-ups or whenever the paper web breaks in the course of a printing operation, chains are usually provided on either longitudinal side of the rotary machine structure, which chains are trained around sprocket wheels and interconnected at intervals by crosswise extending rods whereto the start end of the paper web to be led through the machine may be hitched where required.

For construction reasons, two of said sprocket wheels are to be mounted at locations above the uppermost position of the compensator roller in the corresponding printing unit. In view of this compensator roller not being normally located at its uppermost position but rather at some intermediate position or even further toward the lowermost position thereof, considerable difficulty was experienced heretofore in this area of the machine as the paper web was being transported. The paper web being first transported straight upwards by the cross rod connected to the parallel drive chains, and then moved down again along the chain path. If in this critical situation of paper guiding, the compensator roller happens to be at an intermediate position or possibly at its lowermost position, the inevitable result was that the paper web was left unsupported and unguided during the chain downward movement. Since it was unsupported, the paper web was apt to arrange itself in uneven loops above the trailing paper guide roller, which would come ahead of the compensator roller, with the risk of entangling itself around the guiding roller and being torn off.

To avoid this problem, known rotary printing presses required that the paper web be introduced into the machine with the utmost care and attention, while the speed of the feed-in chains must be slowed considerably (down to approximately 6 m/min), which lengthens the paper web introduction time quite significantly, especially because of the large size of a rotary press.

SUMMARY OF THE INVENTION

It is an object of this invention to provide a device whereby such prior shortcomings can be obviated, while ensuring that the paper web is accurately guided true also at the chain point of reversal above the compensator roller so as to significantly reduce the time required to introduce the paper web into the rotary press.

This object is achieved by the use of an actuator assembly controllable for either high speed or low speed operation which is operatively interconnected with the mechanism for shifting the compensator roller in the vertical direction.

The approach proposed by this invention makes it possible to shift the compensator roller, during the paper web introduction operation, at a high rate from its position for registering the paper web to its uppermost position, where it is located in close proximity with the deflector sprockets for the parallel chains used to transport the paper web through the machine, thus preventing the paper web from arranging itself into uneven loops during this critical stage. The paper web is instead guided in perfect tension when approaching this critical point. The compensator roller may then be returned to its previous position and perform its compensation function.

Further advantages of the invention will be seen from the description which follows, the appended claims, and accompanying drawings.

BRIEF DESCRIPTION OF THE DRAWINGS

The device of this invention will be now described in detail in connection with a preferred embodiment thereof, given herein by way of example only and illustrated in the accompanying drawings, wherein.

DESCRIPTION OF THE PREFERRED EMBODIMENT

Figure 1:
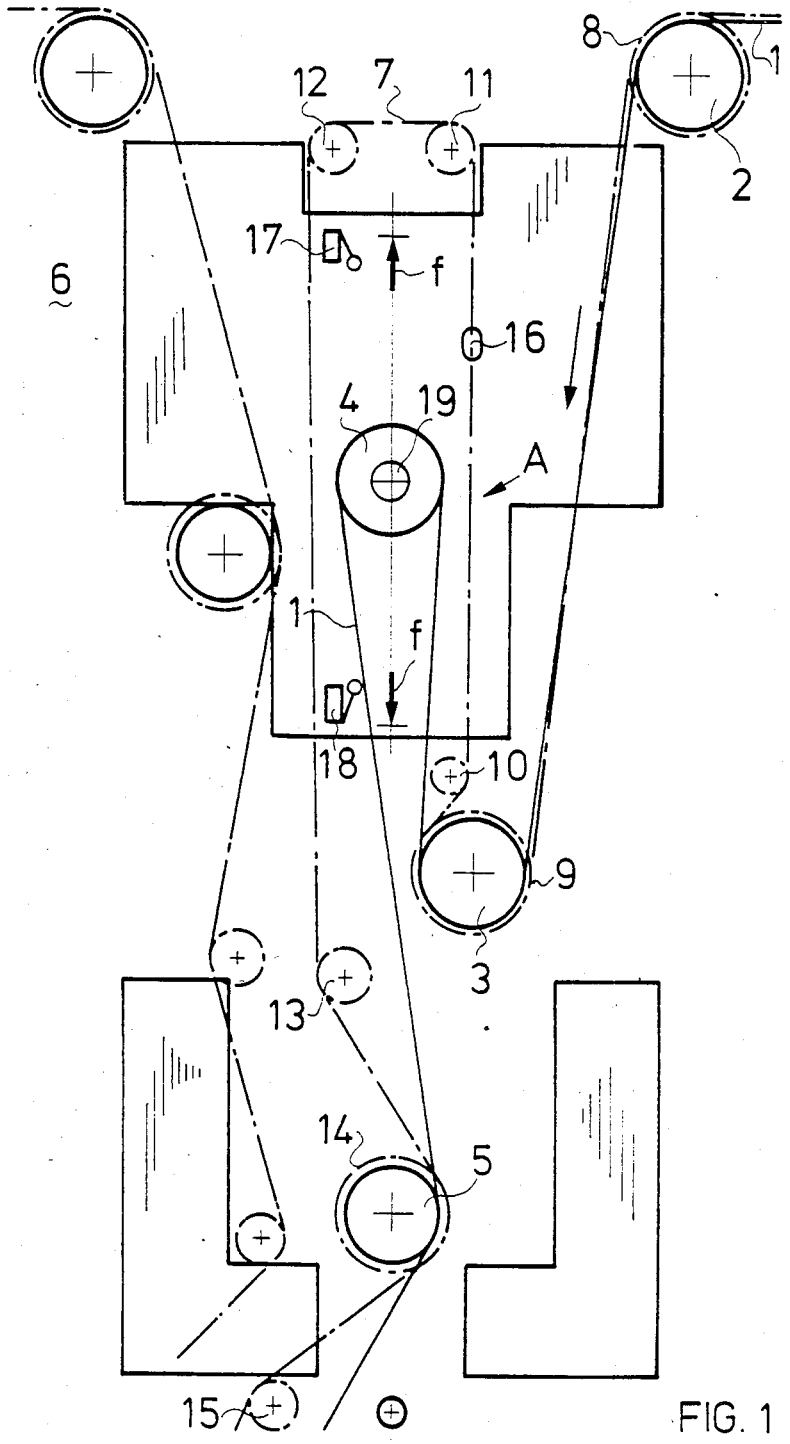
FIG. 1 shows schematically a detail of the structure of a rotary printing press having a compensator roller and a paper feed-in chains.

As shown in FIG. 1, for introducing and transporting a paper web 1 carried on rollers 2,3,4 and 5, chains 7 are provided on either longitudinal side of the rotary press structure, indicated at 6, which chains are driven and guided by sprocket wheels 8,9,10,11,12,13,14 and 15.

In FIG. 1, the paper web 1 is shown by a full line, whereas the chain 7 is shown by a dash-and-dot line. The parallel chains 7 are provided at intervals with cross rods 16 which are operative to engage one end of the paper web 1 to pull and transport the paper web through the rotary press. In a manner known per se, the compensator roller 4 may be shifted up and down in the directions of the arrows "f", and advantageously, to control the uppermost position of the roller a travel limit switch 17 is provided, while a travel limit switch 18 is provided to control the lowermost position thereof.

The basic compensation movement of the compensator roller 4, which takes place with the assistance of a gearing to shift the roller 4 for compensation, will correspond approximately to a rate of 1 mm/s.

While the compensation for out-of-register conditions of the paper web 1 may be provided quite satisfactorily by the compensator roller 4 being shiftable in the vertical direction (arrows "f") with the aid of the conventional mechanism, a serious problem has shown to be that the paper web 1, as picked up by the cross rod 16 and entrained by the chain 7 through the various machine stations, in the event of the compensator roller 4 occupying an intermediate position—as shown in FIG. 1—or an even lower position as the chain 7 moves past the deflector sprockets 11 and 12, tends to arrange itself unevenly and uncontrollably in superimposed loops at the area indicated at A and on the roller 3, which is due to lack of an adequate guide for the web 1. In order to obviate this problem, the improved gearing of this invention is used as illustrated in FIG. 2.

Figure 2:
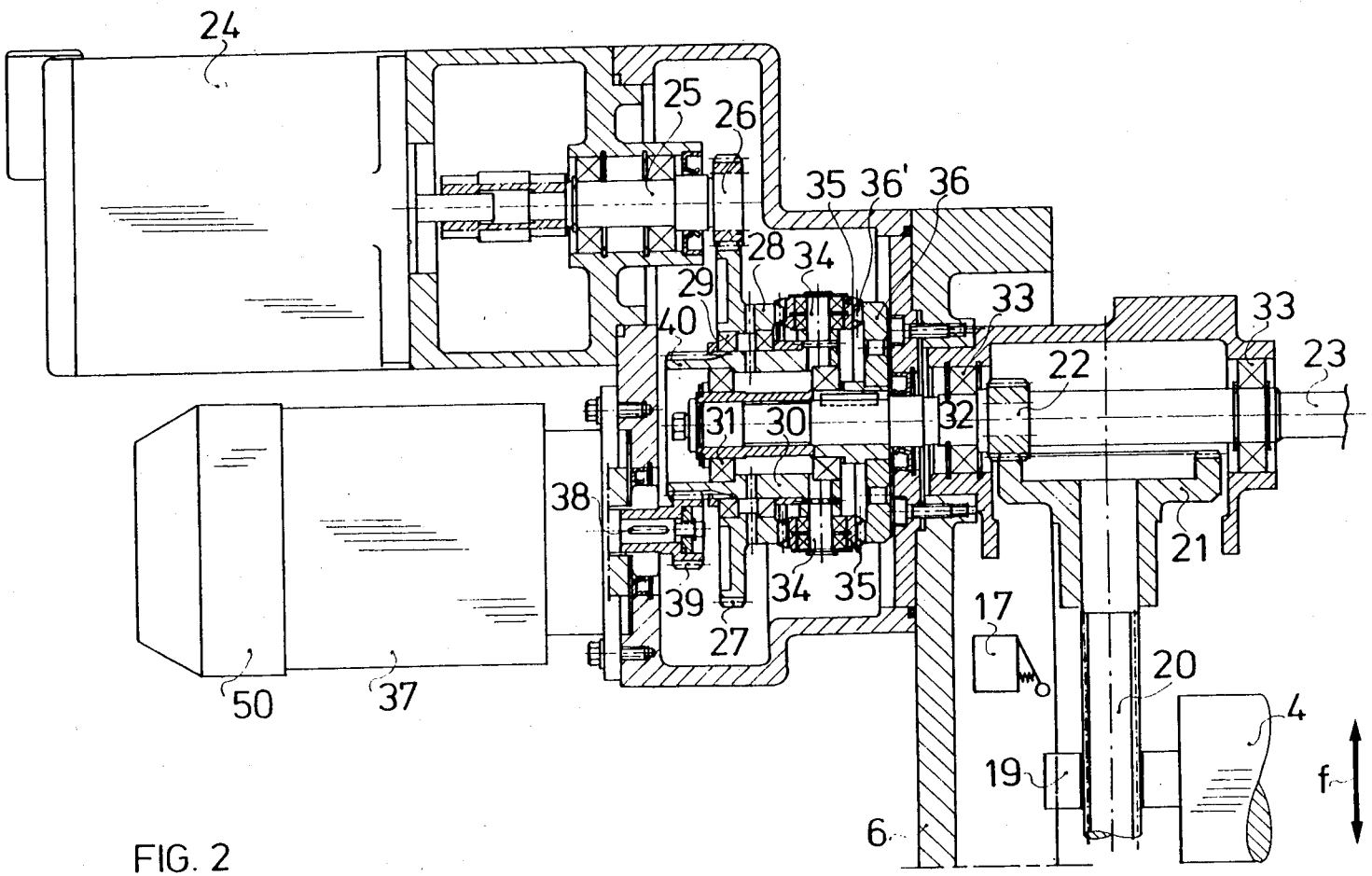
FIG. 2 shows, partly in full view and partly in section, the actuator mechanism according to this invention.

As shown in FIG. 2, the compensator roller 4 has its end hubs 19 connected to threaded parallel extending shafts 20 which are provided at each end of the roller 4 and which carry at the top a crown gear 21 in mesh engagement with a corresponding gear wheel 22 driven by a horizontal shaft 23.

To adjust the roller 4 for compensation of an out-of-register condition of the web 1, a precision controlled motor 24 is provided in a manner known per se, such as a "SLO-SYN" motor type. The shaft 25 of the motor 24 is driven, for example, at 60 rpm, and at this same speed a gear wheel 26 is driven which is rigid with the motor shaft 25, and the motion is transmitted by the gear wheel 26 to a gear wheel 27 which also has front gear teeth 28.

The gear wheel 27 is supported rotatably through bearings 29 on a tubular sleeve 30 rotatably carried, in turn, on a shaft 32 by bearings 31. Shaft 32 is supported on the machine structure 6 with the interposition of bearings 33. Projecting radially from the tubular sleeve 30 are stub shafts 34 mounting planet gears 35 which mesh with the front ring gear teeth 28 defining the sun gear.

Also made rigid with the shaft 32 is an additional gear wheel 36 having a front tooth formation 36', also meshing with the planet gears 35. Mounted to the end of the shaft 32 is the gear wheel 22 which transmits the motion to the crown gear 21. Owing to the motor 24 turning at much reduced rpm, through the gearing just described, the threaded shaft 20, and hence the compensator roller 4, will be shifted with a slow upward or downward movement corresponding to a rate of about 1 mm/s, thus affording a highly accurate adjustment of the position taken by the compensator roller 4.

In order to be able to also move the compensator roller 4 at a high rate, to bring it closer to the sprocket wheels 11 and 12 during the introduction of the paper web 1, according to this invention, there is provided an additional motor 37, e.g. a conventional three-phase motor operated at 1,500 rpm. Advantageously, a motor equipped with a well-known self-braking device 50 could be used. Keyed to the output shaft 38 of the motor 37 is a gear wheel 39 meshing with an outside tooth formation 40 provided on the corresponding end of the tubular sleeve 30 which carries the planet gears 35.

The device according to this invention operates as follows.

On operating the motor 24, through the gear wheel 26, wheel 27 and front toothing 28 thereon, planet gears 35, crown gear wheel 36, and gear wheel 22, the crown gear 21 on the corresponding threaded shaft 20 is imparted a rotary motion which enables the compensator roller 4 to be raised or lowered with a micrometric precision movement, e.g. at the rate of 1 mm/s.

By deactivating the motor 24 and activating instead the motor 37, through the gear wheel 39, toothing 40 on the tubular sleeve 30, planet gears 35 gear wheel 36, and gear wheel 22, an upwardly or downwardly directed movement is generated which is transmitted to the compensator roller 4 and takes place at a high rate, e.g. at 40 mm/s. Thus, as the paper web 1 is being introduced, through the cross rod 16 driven forwardly by the parallel chains 7, the compensator roller 4 is temporarily brought rapidly to its upper position, thereby it is located close to the sprockets 11 and 12 to prevent the paper web, as entrained by the chains 7, from being dropped in an uncontrolled fashion and arranging itself in uneven loops.

After the rod 16 has moved, along with the paper web 1, past the sprocket wheels 11 and 12, the compensator roller end hub 19 is lowered at a high rate together with the paper web resting on top of the roller 4, into the compensation position it occupied previously. Advantageously, the motor 37 could be equipped with a self-braking device to provide a prime mover which can be stopped promptly and accurately with simple controls.

While a preferred embodiment of the invention has been described herein, it is to be understood that it may be embodied within the scope of the appended claims.

We claim:

1. In a rotary printing press including a plurality of sprocket wheels and a plurality of rollers, chains traveling over said sprocket wheels and said rollers and carrying spaced cross rods for engaging an end of a paper web to pull the paper web over a number of said rollers, a compensator roller located below two of said sprocket wheels and vertically movable relative to said sprocket wheels and said rollers to correct out-of-register conditions of a paper web passing over a number of said rollers and means for moving said compensator roller in the vertical direction toward and away from said two sprocket wheels, the improvement comprising a controllable actuator assembly for selectively moving said compensator roller in the vertical direction at a high speed and at a relatively lower speed operatively connected to said means for moving said compensator roller in the vertical direction, said actuator assembly including a first means for moving said compensator roller at a high speed during paper web introduction, a second means for moving said compensator roller at a relatively lower speed into the proper compensation position after the paper web has been introduced and gear means selectively connecting said first means and said second means in driving relation with said means for moving said compensator roller in a vertical direction, whereby the position of the compensator roller prevents a paper web from falling into uneven loops after passing over said compensator roller during introduction.

2. Apparatus as set forth in claim 1 wherein said controllable actuator assembly includes a housing, a first low speed motor having an output shaft, a first gear fixed on said output shaft, a drive shaft rotatably mounted in said housing, a sleeve rotatably mounted on said drive shaft, an idler gear having front gear teeth formed thereon mounted on said sleeve, said sleeve having a plurality of outwardly and radially extending stub shafts attached thereto and a planet gear rotatably mounted on the end of each of said stub shafts and having gear teeth in mesh engagement with said front gear teeth on said idler gear wheel, a gear wheel fixed on said drive shaft and having front gear teeth in mesh engagement with said planet gears, additional spaced gear wheels mounted on said drive shaft, crown gears keyed to threaded shafts operatively connected to said compensator roller and in mesh engagement with said additional spaced gear wheels fixed on said drive shaft, outside gear teeth formed on one end of said sleeve, a second higher speed motor having an output shaft and a gear fixed to said output shaft in mesh engagement with said outside gear teeth formed on one end of said sleeve, whreby said first motor moves said compensator roller vertically at a slow speed and said second motor moves said compensator roller vertically at a relatively higher speed.

3. Apparatus according to claim 2 wherein said second motor includes a self-braking device.

* * * * *